US006330957B1

(12) United States Patent
Bell-Greenstreet

(10) Patent No.: US 6,330,957 B1
(45) Date of Patent: Dec. 18, 2001

(54) AUTOMATIC MEDICATION DISPENSER

(76) Inventor: Daryl L. Bell-Greenstreet, 745 W. Paraiso Pl., Green Valley, AZ (US) 85614

( * ) Notice: Subject to any disclaimer, the term of this patent is extended or adjusted under 35 U.S.C. 154(b) by 0 days.

(21) Appl. No.: 09/212,647

(22) Filed: Dec. 15, 1998

(51) Int. Cl.[7] ..... G07F 11/00

(52) U.S. Cl. ..... 221/3; 221/120

(58) Field of Search ..... 221/3, 7, 2, 9, 221/13, 119, 120, 76, 82, 133

(56) References Cited

U.S. PATENT DOCUMENTS 4,573,606 * 3/1986 Lewis et al. ..... 221/3
5,176,285 * 1/1993 Shaw ..... 221/3

* cited by examiner

*Primary Examiner*—Kenneth W. Noland
(74) *Attorney, Agent, or Firm*—The Halvorson Law Firm

(57) ABSTRACT

The present invention is an automatic medication dispenser that is capable of distributing medication according to at least one prescribed time schedule, such as daily or weekly. The dispenser is capable of signaling to the patient the appropriate time for taking the next dosage of medicine by the activation of appropriate alarms. The dispenser has a housing with a removable cap, the housing adapted to receive at least one circularly shaped medication cassette, the at least one medication cassette being rotatable within the housing; a medication exit slot in the housing which allows medication contained by the at least one medication cassette to be distributed from the at least one medication cassette; a drive system contained by the housing which rotates the at least one medication cassette within the housing and a medication detector which is contained by the housing and detects the distribution of the medication, in combination with at least one removable circularly shaped medication cassette. Each of the at least one circularly shaped medication cassettes further comprises a circularly shaped backing plate with an axially located, cam-shaped aperture having a cam-shaped edge, a cam-shaped partition located along the cam-shaped edge and projecting perpendicularly from backing plate, a circularly shaped partition that is co-axial with the cam-shaped aperture and also projects perpendicularly to the backing plate, and a plurality perpendicularly mounted fins extending radially from the center of the backing plate. The medication detector has a transmitter that emits light, and a light detector that detects the light emitted from the transmitter.

10 Claims, 11 Drawing Sheets

AUTOMATIC MEDICATION DISPENSER

FIELD OF THE INVENTION

The present invention relates to the field of medication dispensing devices. More particularly, the present invention relates to an automatic medication dispenser that is capable of distributing medication according to at least one prescribed time schedule. Additionally, the present invention is capable of signaling to the patient the appropriate time for taking the next dosage of medicine by the activation of appropriate alarms.

BACKGROUND

The importance of sequencing and administering prescription medication cannot be over-stressed. Improper administration of prescribed medication is reportedly one of the most common causes for non-response to medical treatment. Frequently, patients forget to take their medication, especially when the administration schedule is complex. Complications can arise when a patient attempts to "catch up" on missed medication by taking additional medication during the next scheduled medication administration. Moreover, since the rate of absorption or detoxification of various drugs may vary widely or may be cumulative, insufficient time between dosages may result in serious side reactions, especially in the nervous system, the cardiovascular system, the respiration system or even the gastrointestinal track. Therefore, it is important that the patient follow the proper medication administration schedule.

By far the largest problem faced when following a medication administration schedule is remembering exactly when to take the next prescribed medication dosage. This is especially true for complex administration schedules or elderly patients who do not have sufficient mental alertness to keep track of the administration schedule. Further, some medications interfere with the mental processes thereby making it difficult to remember the proper administration schedule or schedules.

Traditional drug distribution techniques found in nursing homes and hospitals also suffer from a number of significant problems. In nursing homes and hospitals, it is not uncommon for a particular patient to be prescribed several different pills with different combinations of those pills to be dispensed at a different time of the day. It is usually the responsibility of the nurse to chart and dispense the pills to each patient according to complex personalized administration schedule. Often, though it is poor practice, the nurse will dispense pills to all the patients in the ward, after which, from memory, the pills dispensed to each patient will be charted. This practice may ultimately result in poor patient care or an increased cost to the patient or the hospital One attempt at solving these and other problems has been single compartment pill containers of the type that are typically provided by a druggist. These single compartment pill containers have no provision for the orderly distribution of the contained medication according to a complex administration schedule. Furthermore, with the advent of child proof containers, these druggist provided containers are frustrating and difficult for dexterity challenged patients to use.

Another attempt, used especially when the patient takes a variety of medications, is a segmented container that segregates the different types of medication into different compartments. These segmented containers, however, are not adapted to hold the medication in an ordered arrangement according to a complex distribution schedule. Also, such pill containers are generally small and require frequent replenishment. Further, there is the possibility that a person may confuse like looking pills, resulting in incorrect dosages being taken or placed in each compartment.

A further device is a pill container that includes a cap that has a manually operated timer. After a pill is distributed, the timer is reset for the next pill distribution. However, cap mounted timer are not effective when a variety of different pills need to be distributed over a complex distribution schedule since the patient must still remember the time difference between each pill distribution and which specific pill is to be distributed during each distribution.

Perhaps the most well known timed mediation dispenser is the blister pack used with oral contraceptives taken on a daily schedule. The blister pack has an array of plastic blisters defining individual compartments for each pill. A frangible backing sheet, which is successively numbered, lies behind each compartment indicating the order in which the pills must be taken. However, many medications are to be taken at a specific time each day and this dispenser does not provide a reminder for the time of day.

There are pill storage containers that have been developed to hold a patient's supply of medicine and remind the patient when to take the medicine. For example, Hicks et al., in U.S. Pat. No. 4,275,384, discloses a portable medicine cabinet with a timer and individual compartments for pill containers. This device alerts the patient when the medicine in a particular canister should be taken, and the patient then physically removes the canister from the cabinet, determines the prescribed dosage and manually removes that dosage from the canister, repeating this process for each canister as often as pills are required to be taken from that canister.

Another example is U.S. Pat. No. 4,223,801, issued to Carlson, which discloses a multi-compartment pill container that can be filled with one day's requirement of prescribed drugs. Each individual compartment is capable of holding pills of different types, and each individual compartment is illuminated when the pills therein are to be taken by the patient. This device is controlled by a timed alarm and a timer reset switch that is depressed by the patient after taking the required medicine. However, this apparatus does not dispense the medication but requires an individual to pick pills out of the compartments by hand. Because the timer reset switch is more easily accessible than the pill storage compartments themselves, a weary patient is tempted to simply press the reset button to stop the alarm without taking the medicine.

Thus, the prior art abounds with examples or rotary and like pill dispensers but these, in the main, suffer from one or more drawbacks resulting from the multiple requirements that the instrument be simple, convenient, low-cost, durable and capable of functioning over an extended period of time divided into dosage intervals and particularly wherein the intervals require more than one kind of pill.

However, to date, there is no simple, dependable means for administering various medications according to a complex distribution schedule that is available to those taking medication. It would therefore be a decided advance in the art to provide a drug dispenser which would automatically dispense and advise a patient exactly when to take a specific pill from a series of pills that are to be taken over the course of a day.

For the purpose of this description, the word "pills" is used as a representative term for pills, capsules, tablets, pellets, and like forms of medication, and is not intended to limit the scope of the invention in any way.

SUMMARY OF THE INVENTION

It is an object of the present invention to provide a device that is capable of dispensing medication.

It is another object of the present invention to provide a device that is capable of automatically dispensing medication according to a set prescribed daily schedule.

It is a further object of the present invention to provide a device that is capable of detecting when medication has been dispensed and alerting the patient of the dispensation.

It is yet another object of the present invention to provide a device that automatically dispenses medication according to a set prescribed weekly schedule.

It is yet a further object of the present invention to provide a medication dispensation cassette system wherein a cassette having numerous compartments is pre-filled and loaded into the automatic medication dispensing machine, the automatic medication dispensing machine being capable of receiving at least one of the medication cassettes.

BRIEF DESCRIPTION OF THE DRAWINGS

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings wherein:

FIG. 15 is a top and side view of a medication cassette according to the present invention;

DESCRIPTION OF PREFERRED EMBODIMENTS

Figure 1:
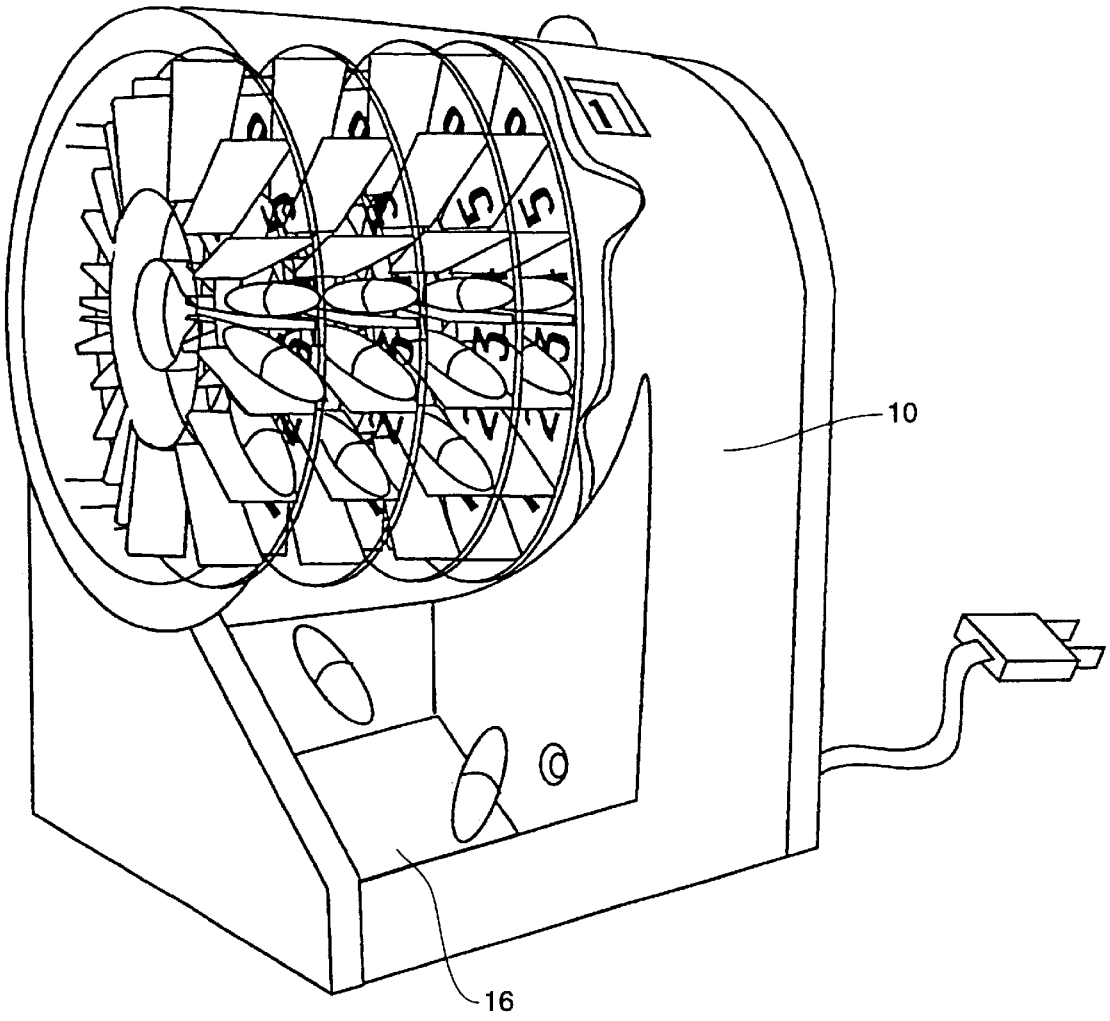
FIG. 1 is a perspective view of the present invention, a portion of the front has been cut-away to clearly illustrate a multi-cassette capability.
Figure 2:
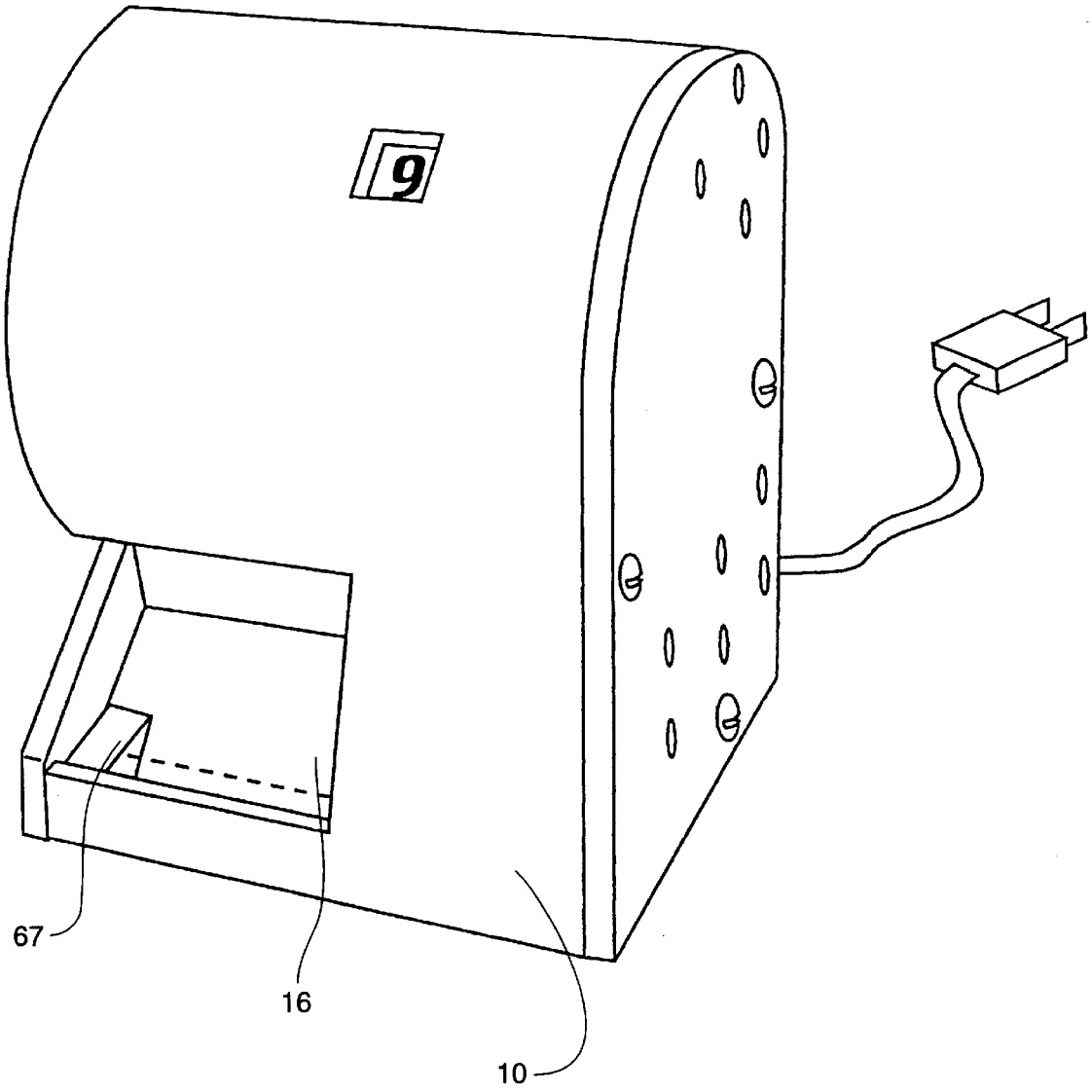
FIG. 2 is a second perspective view of the present invention.
Figure 3:
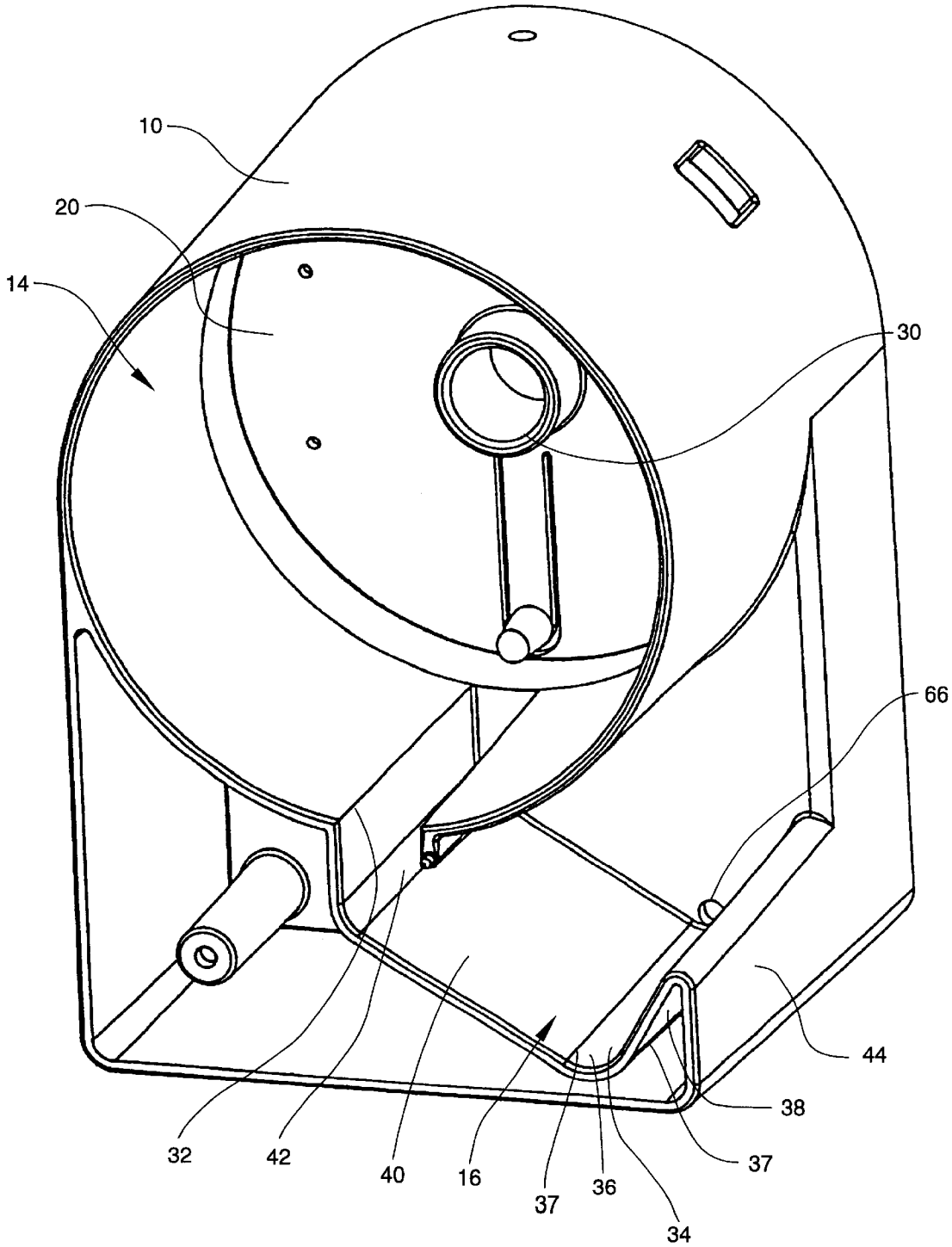
FIG. 3 is a perspective view of the housing of the present invention clearly illustrating the cassette sub-housing and pill receiving sub-housing.
Figure 4:
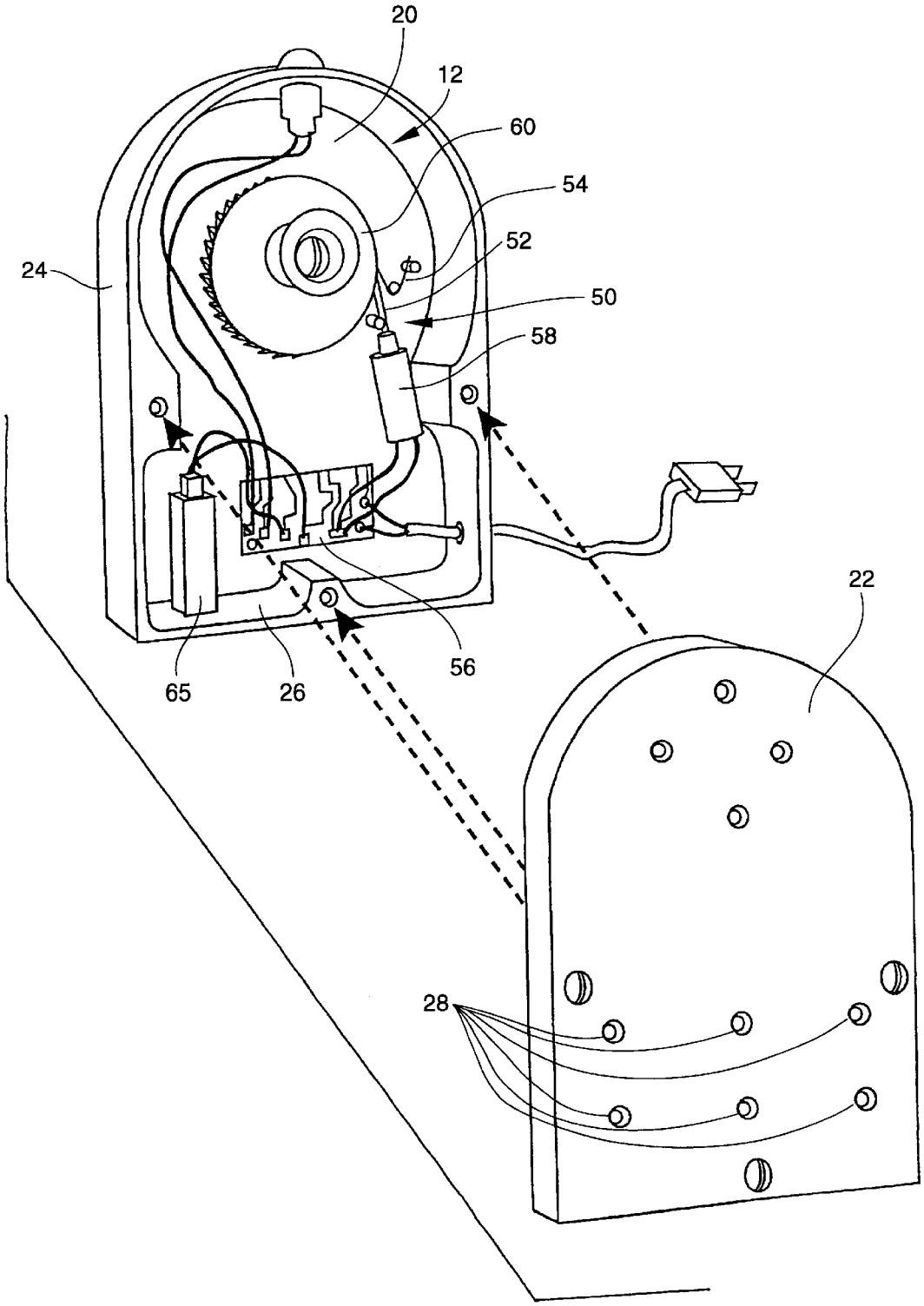
FIG. 4 is a perspective of the present invention clearly illustrating the motor sub-housing.
Figure 5:
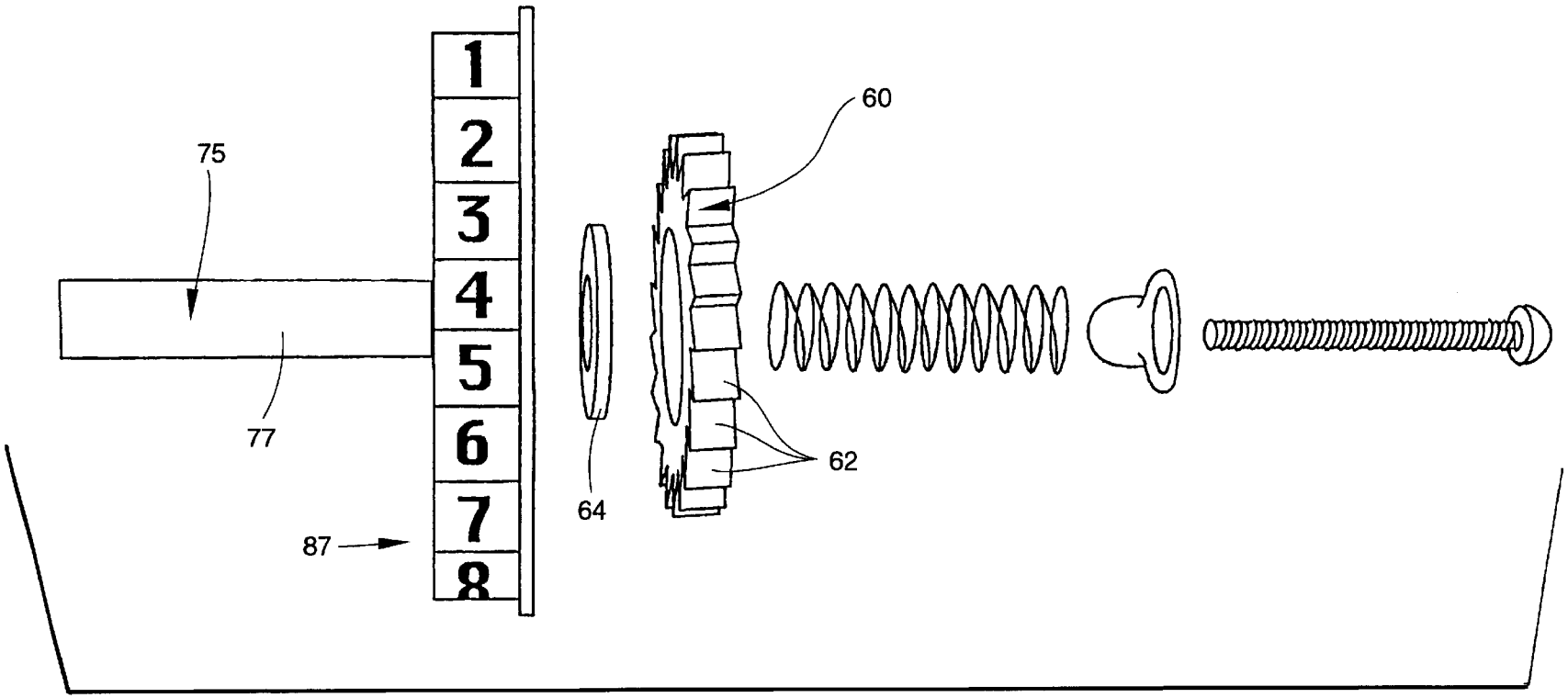
FIG. 5 is a an exploded view of the gear assembly and cassette drive assembly, according to the present invention.
Figure 7:
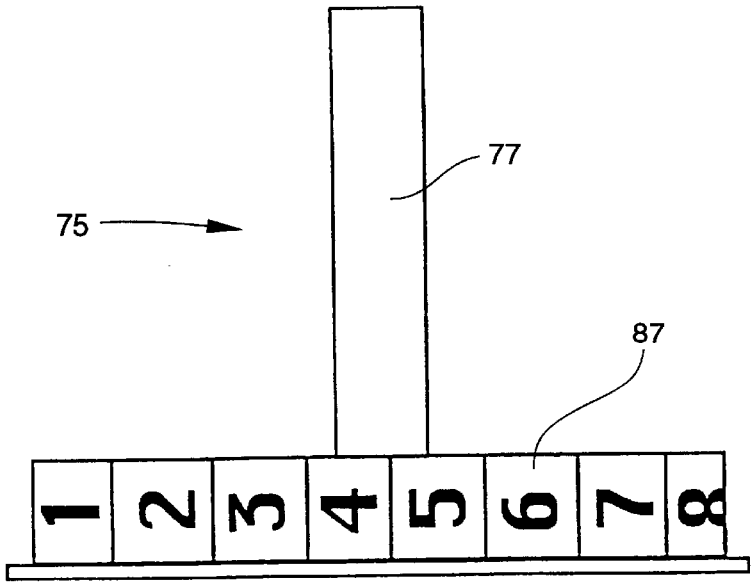
FIG. 7 is a side view of the cassette drive assembly according to the present invention.
Figure 6:
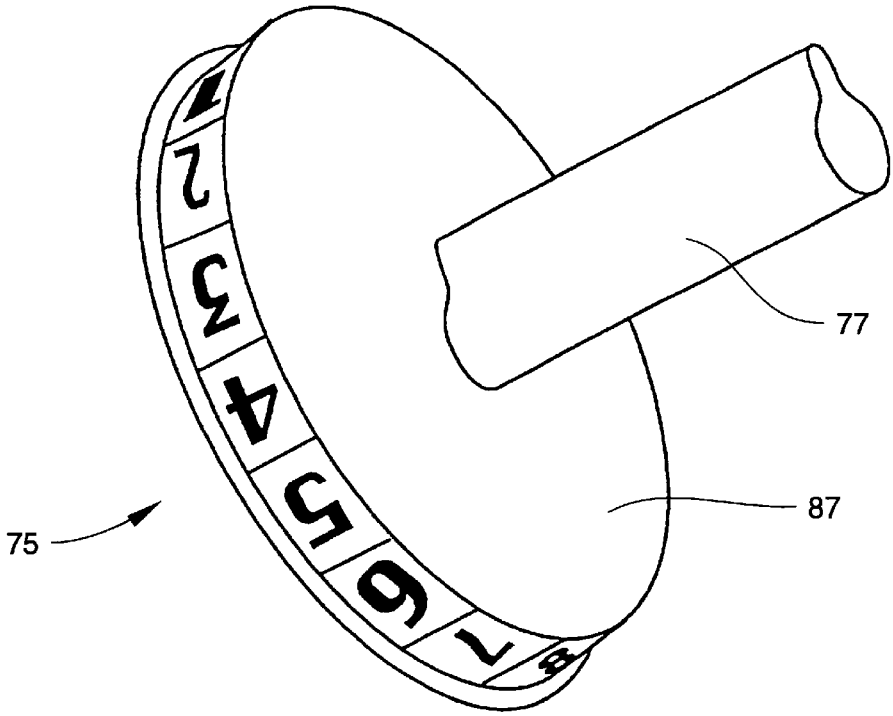
FIG. 6 is a perspective view of the cassette drive assembly according to the present invention.
Figure 9:
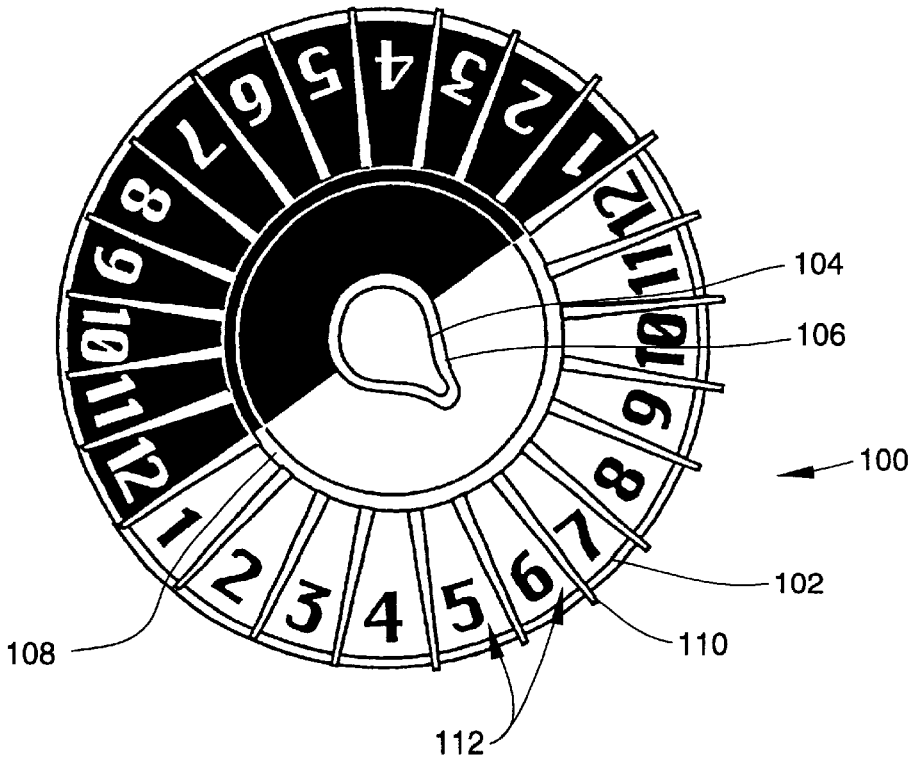
FIG. 9 is a top, or front, view of the medication cassette according to the present invention.
Figure 8:
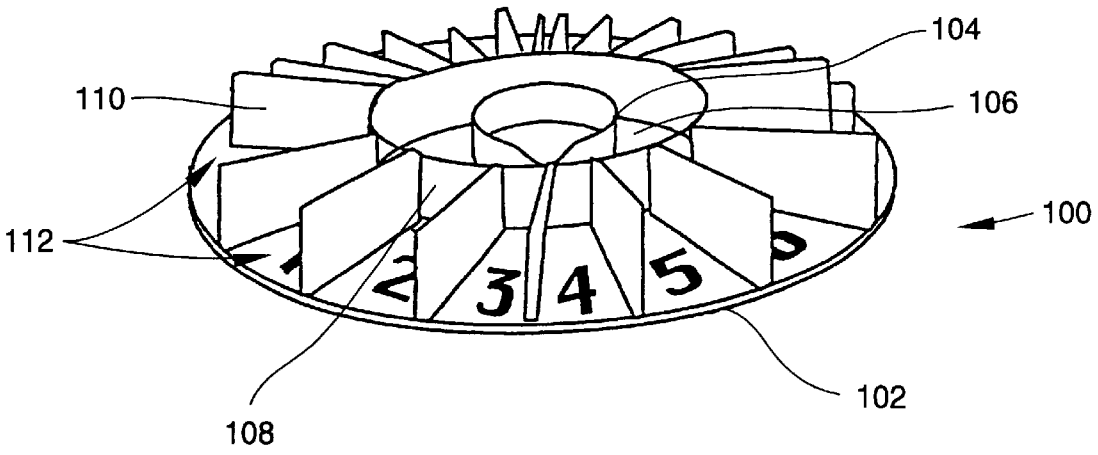
FIG. 8 is perspective view of the medication cassette according to the present invention.
Figure 11:
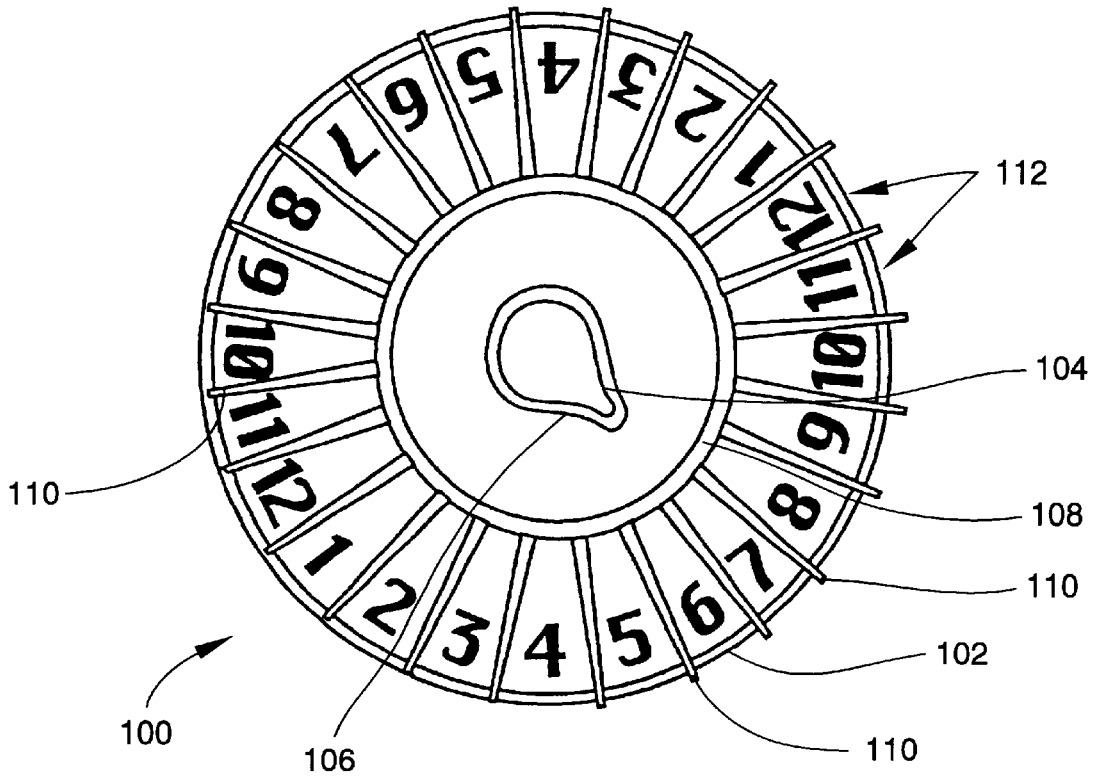
FIG. 11 is a top view of the alternate embodiment medication cassette according to the present invention.
Figure 10:
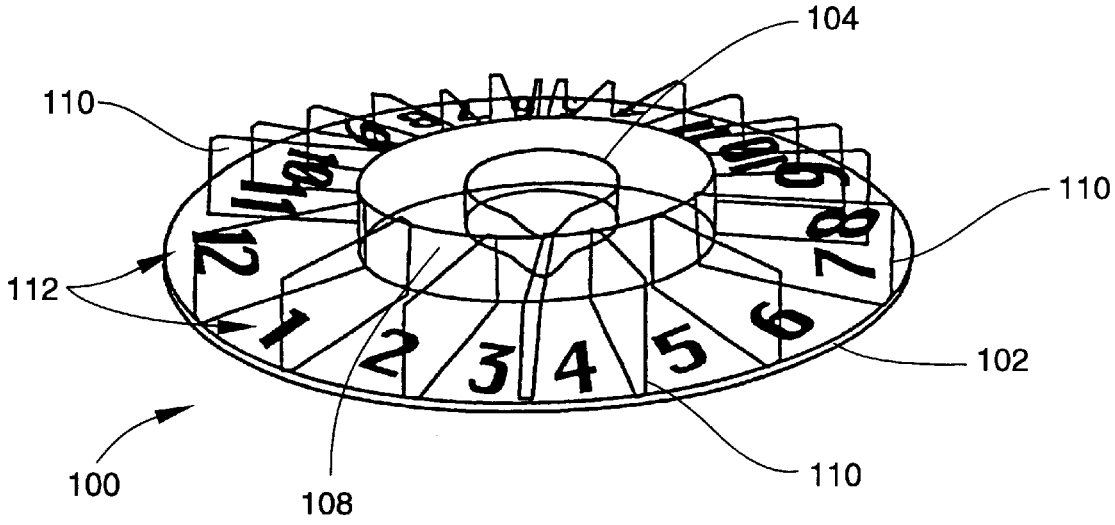
FIG. 10 is a perspective view of an alternate embodiment of the medication cassette wherein the cassette is made from a clear material.
Figure 13:
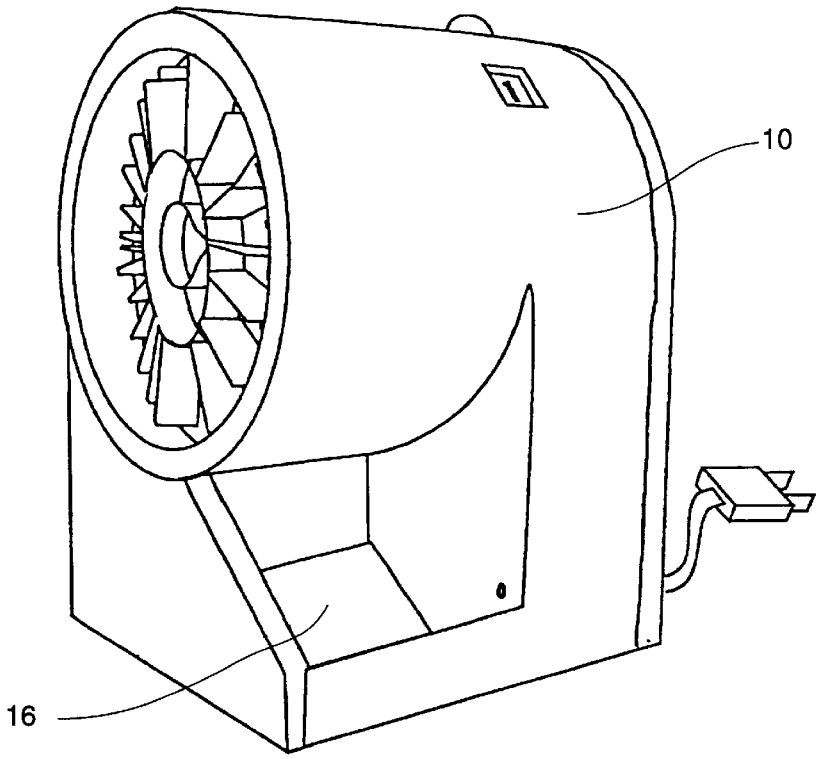
FIGS. 12 and 13 illustrate how a medication cassette is loaded into the housing of the present invention.
Figure 12:
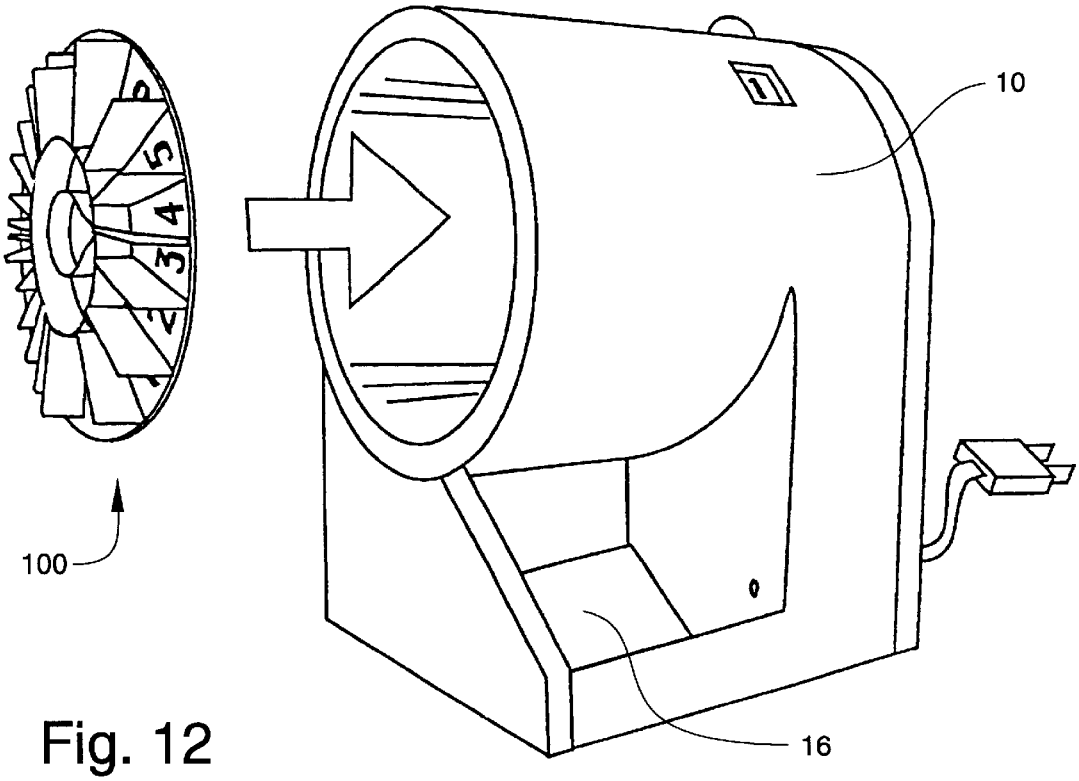
Figure 15:
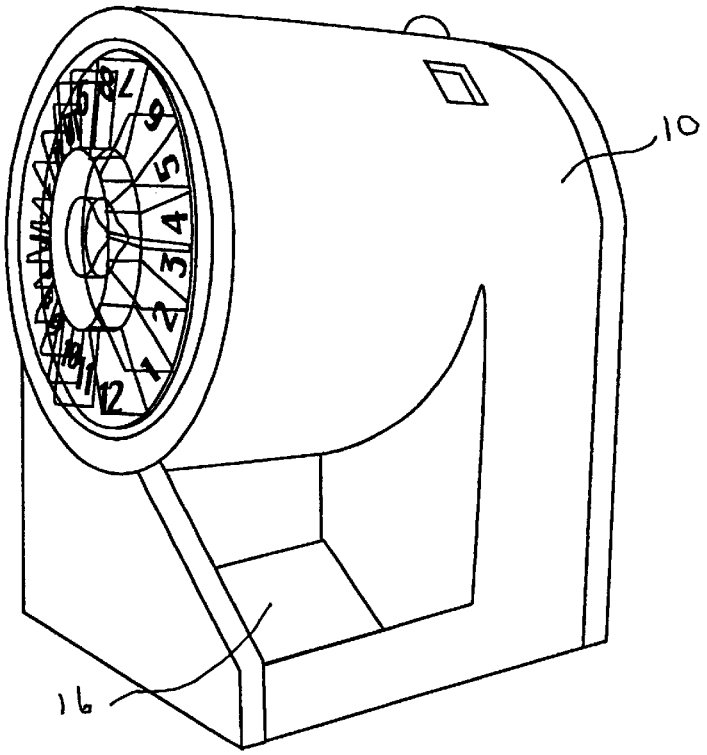
FIGS. 14 and 15 illustrate how the alternate medication cassette is loaded into the housing of the present invention.
Figure 14:
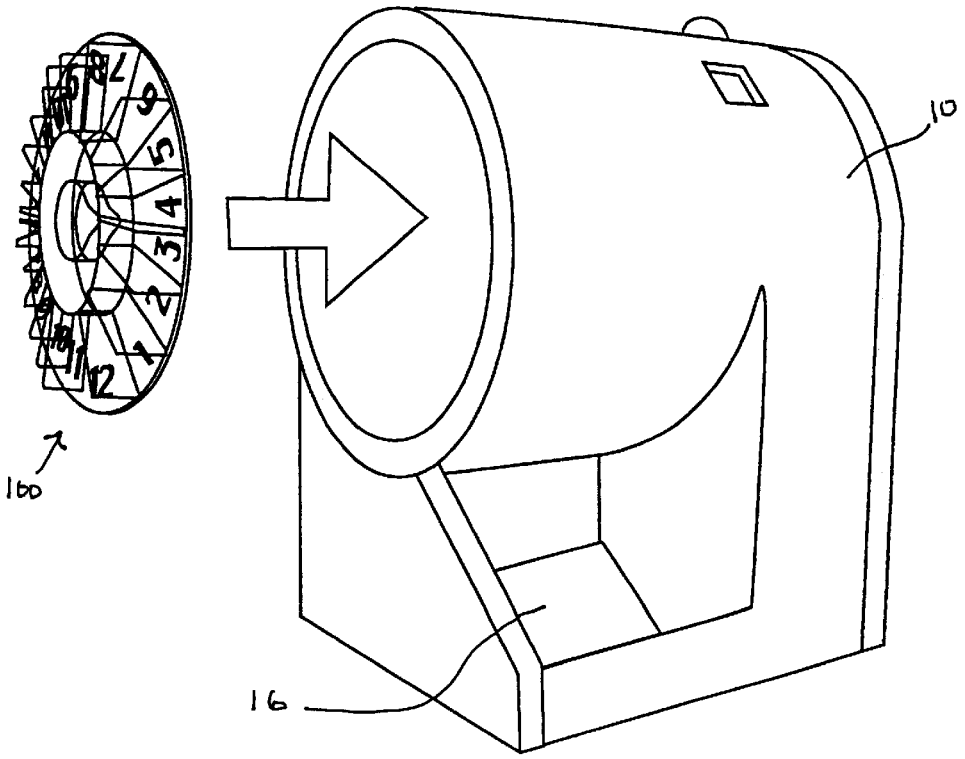
Figure 16:
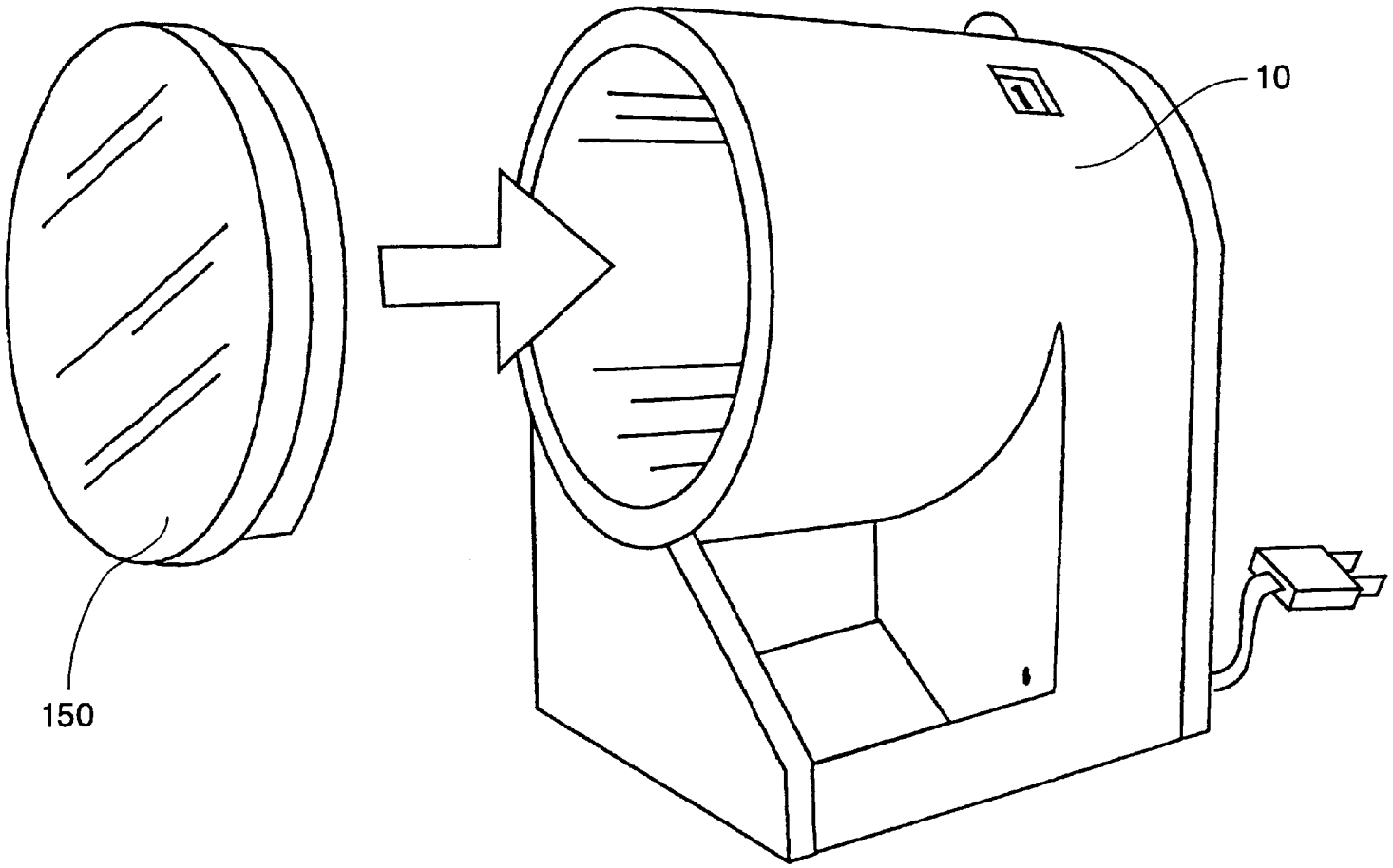
FIG. 16 illustrates how the cap structure is attached to the housing of the present invention.

The present invention is a device useful for the automatic distribution of medication according to a prescribed dispensation schedule. Additionally, the present invention informs a patient that medication is to be taken upon the detection of the dispensed medication.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

FIG. 1 shows a perspective view of the automatic pill dispenser according to the present invention. There is a main housing 10 that includes a motor sub-housing 12 coupled to a cassette sub-housing 14. The cassette sub-housing 14 is positioned over a pill receiving sub-housing 16. Portions of the cassette sub-housing 14 are illustrated cut-away for descriptive purposes.

The motor sub-housing 12 has a front wall 20 and a back wall 22, preferably substantially parallel to the front wall 20. The front and back walls 20 and 22 are coupled through an intervening side wall 24 extending from edges of the front wall 20 to edges of the back wall 22. The back wall 22 is removably attached to the side wall 24 to provide access to components contained within the motor sub-housing 12. The back wall 22 further has a series of holes or slots 28 that extend through the back wall 22 and are used for ventilation and aesthetic purposes. Additionally, a bottom wall 26 extends from the front wall 20 to the back wall 22 and is located near bottom ends of each respective wall. While the shapes of the front and back walls, 20 and 22, are non-critical, it is preferred that they have an elongated D-shape, with the arc of the D-shape occurring at a top end of the front and back walls, 20 and 22 respectively.

Preferably, the cassette sub-housing 14 is substantially tubular in shape and defines an interior chamber adapted to receive at least one medication cassette(s) 100. One end of the cassette sub-housing 14 is attached near a top end of the front wall 20 of the motor sub-housing 12. The opposite end of the tubularly shaped cassette sub-housing 14 is open and adapted to receive the at least one medication cassette 100. An aperture 30 extending through the front wall 20 of the motor sub-housing 12 is co-axial with the tubularly shaped cassette sub-housing 14 and provides mechanical access to the interior of the cassette sub-housing 14 from the motor sub-housing 12. Additionally, a longitudinal slot 32 in a lower or bottom location of the cassette sub-housing 14 is provided to allow pills from any received at least one medication cassette(s) 100 to exit the cassette sub-housing 14 into the pill receiving sub-housing 16.

Pill receiving sub-housing 16 is located beneath the cassette sub-housing 14 and receives pills or medication that exits from the interior of the cassette sub-housing 14 through the slot 32. The pill receiving sub-housing 16 necessarily has a receiving channel 34 that ultimately receives and holds the dispensed medication. Preferably, the receiving channel 34 is defined by a bottom segment 36 with two opposed edges 37 that extends outward from the front wall 20 of the motor-sub-housing 12. The bottom segment 36 may be either flat or curved to receive and hold dispensed pills. First and second angled ramps 38 and 40 extend from the front wall 20 of the motor-sub-housing 12 and attach to each of the two opposed edges 37 of the bottom segment 36. The first and second angled ramps 38 and 40 serve to direct dispensed pills to the bottom segment 36. A first horizontal wall 42 that extends from the first angled ramp 38 to the cassette sub-housing 14 and attaches at one end to the front wall 20 of the motor sub-housing 12. Finally, an end wall 44 terminates the bottom segment 36, the first and second angled ramps 38 and 40 and the first horizontal wall 42.

The front wall 20, back wall 22, bottom wall 26 and intervening side wall 24 of the motor sub-housing 12 define an interior compartment containing a drive motor assembly 50. The drive motor assembly 50 functions to rotate about a drive axis the at least one pill cassette(s) 100 which are received within the cassette sub-housing 14. Preferably, the drive motor assembly 50 has a ratchet wheel 60 that is driven by a ratchet 52. A pawl 54 is included to prevent counter rotation of the ratchet wheel 60. The drive motor assembly is controlled and activated by an electronic control circuit 56. The drive motor assembly 50 will be described in greater detail below.

Ratchet wheel 60 has a first cylindrical section 62 with a plurality of ratchet teeth 63 located about an outer circumference. A second, smaller, cylindrical section 64 is co-axially attached to the first cylindrical section 62 and is adapted to be rotatably received by aperture 30 located in the front wall 20. Once received within the aperture 30, a portion of the second cylindrical section 64 projects past the front wall 20 and into the interior chamber defined by the cassette sub-housing 14. The projecting portion of the second cylindrical section 64 has a shape such that the cassette drive assembly 75 may receive it.

Ratchet 52, which drives the ratchet wheel 60, is itself driven by a solenoid 58. When current is applied to the solenoid 58, the ratchet 52 is thrown outward engaging the ratchet teeth 63 and rotating the ratchet wheel 60 about the drive axis. The solenoid 58 and ratchet 52 assembly is mounted to the interior of the motor sub-housing 12 to a surface of the front wall 20.

Pawl 54 is a spring biasing wire that is also attached to the interior of the motor sub-housing 12 and is positioned to engage the ratchet teeth 53 of the ratchet wheel 60. When the ratchet wheel 60 rotates, the pawl 54 is displaced outwardly by the ratchet teeth 53 until it snaps into a new position beneath each individual tooth. This effectively prevents the ratchet wheel 60 from counter rotation. Alternatively, the ratchet 52 can be driven by a gear assembly, belt drive, or other like drive structures that serve to advance rotationally mounted components.

The cassette drive assembly 75, which is located within the cassette sub-housing 14 and receives the projecting portion of the second cylindrical section 64 of the ratchet wheel 60, has a drive shaft 77 with first and second ends, 79 and 81, respectively. The first end 79 has an interior axial chamber 83 adapted to receive the portion of the second cylindrical section 64 which projects into the interior chamber of the cassette sub-housing 14. The drive shaft 77 has a teardrop-shaped cross section that receives and cooperates with the at least one pill cassette(s) 100 to transfer motion from the ratchet wheel 60 to the at least one cassette(s) 100. The cassette drive assembly 75 further includes a cylindrically shaped base portion 87 that is an aid in the axial alignment of the drive shaft 77 and has a series of numbers located on a circumferential surface. The series of numbers, half black on white with the remaining half white on black, act as time indicators and are plainly visible through a time window provided in the cassette sub-housing 14. Additionally, there may be included in the present invention a day indicator that indicates different days of the week. The day indicator would only be found on a weekly dispensing model, and not on a daily dispensing model. Preferably, the series of numbers may be backlit to provide visibility during low light and dark conditions.

Each at least one pill cassette(s) 100 includes a circular back plate 102 with an axially located aperture 104 that is adapted to receive the cassette drive assembly 75. In the preferred embodiment, the aperture 104 has a teardrop shape. A first partition 106 projects perpendicular to the back plate 102 and follows the edge of aperture 104. Accordingly, the first partition 106 is also teardrop shaped. The first partition 106 aids in alignment of the cassette 100 on the cassette drive shaft 75 and further serves to assist in the transfer of angular momentum from the cassette drive shaft 75 to each cassette 100. A second circularly shaped partition 108 also projects perpendicular to the back plate 102 and is co-axial with the circular back plate 102. The second partition 108 has a larger circumference than the first partition 106 and is radially located outward from the first partition 106. Finally, at least two flanges 110 extend radially from the second partition 108 to an outer edge of the back plate 102 and form at least two compartments 112 adapted to received medication or pills. Consequently, the second partition 108 forms a common wall for all the compartments 112. In the most preferred embodiment, there are twenty-four flanges 110 that form twenty-four compartments 112. Thus, each compartment 112 can be homomorphically mapped onto each hour of the day.

In the most preferred embodiment of the present invention, a series of six cassettes are received within the cassette sub-housing 14. When two cassettes are placed adjacent to each other, the back plate 102 of the outward cassette serves as a front wall for the compartments 112 of the inward cassette. Likewise, when the cassettes 100 are received within the cassette sub-housing 14 an interior wall of the cassette sub-housing 14 acts as an outer wall for the compartments 112 thereby containing the medication. Cap structure 150 serves as a front wall for the compartments 112 of the outermost cassette of the series. Moreover, the cap structure 150 ensures the retention of the cassettes 100 in the cassette sub-housing 14. Preferably, the cap structure will have a circularly shaped outer wall that has a diameter slightly greater than that of each cassette 100. Thus, a cassette may be placed within an upturned cap structure 150 to facilitate loading of medication into the cassette 100.

The electronic control circuit 56 that times and controls the rotation of the pill cassettes 100 comprises two D.C. power sources, solenoid driver circuitry, and logic circuitry capable of providing the measured one hour time intervals necessary for dispensing the pills. The first D.C. power source provides a suitable voltage and current for activating the solenoid 58 and is derived from an ordinary residential outlet supplying 120 VAC. The second D.C. power source is used by logic circuitry that produces a measured time interval and is derived from the first D.C. power source. Therefore, in timed increments, such as according to an hourly division of a single day or subdivisions of a single week, the logic circuitry, by design, activates the solenoid driver circuitry causing the ratchet to rotate the ratchet wheel and thereby dispensing the pills through the longitudinal slot 32 and into the pill receiving sub-housing 16. In the preferred embodiment, the measured time intervals were chosen to be one-hour increments, however, alternative increments, such as subdivisions of a week, may be provided and still fall within the scope of the present invention.

Electronic control circuit 56 also includes a transmitter unit 65 that transmits light energy through an aperture 66 in the front wall 20 of the motor sub-housing 12 that is located slightly above the bottom segment 36 of the pill receiving sub-housing 16. A photodetector 67 with detecting characteristics selected to match the light emitting characteristics of the transmitter unit 65, is aligned to receive that light energy emitted from the transmitter unit 65. By aligning the transmitter unit 65 with the photodetector 67 a light beam is directed along the longitudinal slot 32. Alternatively, by placing the transmitter unit 65 and the photodetector 67 adjacent to each other, it is also possible to provide a reflecting light condition. Thus, when pills are received within the longitudinal slot 32, the light beam is broken or reflected. Satisfaction of this condition activates an appropriate logic circuit in the electronic control circuit 56 further setting off audible and/or visual alarms.

While these descriptions directly describe the above embodiments, it is understood that those skilled in the art may conceive modifications and/or variations to the specific embodiments shown and described herein. Any such modifications or variations that fall within the purview of this description are intended to be included therein as well. It is understood that the description herein is intended to be illustrative only and is not intended to be limitative. Rather, the scope of the invention described herein is limited only by the claims appended hereto.

What is claimed is:

1. A device for the automatic distribution of medication comprising:

a) at least one removable medication cassette;

b) a housing which receives the at least one medication cassette, the at least one medication cassette being rotatable within the housing;

c) a medication exit slot in the housing which allows medication contained by the at least one medication cassette to be distributed from the at least one medication cassette;

d) a drive system contained by the housing which rotates the at least one medication cassette within the housing and e) a medication detector which is contained by the housing and detects the distribution of the medication, whereby when the medication detector detects the medication an alarm is triggered; and wherein each of the at least one medication cassette further comprises a backing plate with a centrally located, cam-shaped aperture having a cam-shaped edge, a cam-shaped partition located along the cam-shaped edge and projecting perpendicularly from backing plate, a circularly shaped partition that is co-axial with the cam-shaped aperture and also projects perpendicularly to the backing plate, and a plurality perpendicularly mounted fins extending radially from the center of the backing plate, whereby compartments are formed between each adjacent pair of the plurality of perpendicularly mounted fins.

2. The device of claim 1 wherein the compartments formed by adjacent pairs of the plurality of perpendicularly mounted fins further includes scheduling indicia.

3. The device of claim 2 wherein there are twenty-four compartments formed by adjacent pairs of the plurality of perpendicularly mounted fins.

4. The device of claim 3 wherein the medication detector has a transmitter that emits light, and a light detector which detects the light emitted from the transmitter, whereby when medication is dispensed from at least one of the medication cassettes, the light detected from the transmitter is interrupted and an alarm which is included in the circuit of the transmitter and detector is activated.

5. The device of claim 4 wherein the housing further includes a time indicating slot where a numeral representing each hour of a day is visible, the numeral representing each hour of the day further increments at an hourly rate.

6. The device of claim 5 wherein the housing further includes a removable cap with raised sides, the diameter of the raised sides of the cap being slightly greater than that of the medication cassettes, thus each medication cassette is adapted to fit with in the cap to aid in the placement of medication within the medication cassette.

7. A device for automatic distribution of medication comprising:

a) a housing with a removable cap, the housing adapted to receive at least one circularly shaped medication cassette, the at least one medication cassette being rotatable within the housing;

b) a medication exit slot in the housing which allows medication contained by the at least one medication cassette to be distributed from the at least one medication cassette;

c) a drive system contained by the housing which rotates the at least one medication cassette within the housing and d) a medication detector which is contained by the housing and detects the distribution of the medication, e) in combination with at least one removable circularly shaped medication cassette;

whereby when the medication detector detects the medication an alarm is triggered; and wherein each of the at least one circularly shaped medication cassettes further comprises a circularly shaped backing plate with an axially located, cam-shaped aperture having a cam-shaped edge, a cam-shaped partition located along the cam-shaped edge and projecting perpendicularly from backing plate, a circularly shaped partition that is co-axial with the cam-shaped aperture and also projects perpendicularly to the backing plate, and a plurality perpendicularly mounted fins extending radially from the center of the backing plate, whereby compartments are formed between each adjacent pair of the plurality of perpendicularly mounted fins.

8. The device of claim 7 wherein the medication detector has a transmitter that emits light, and a light detector that detects the light emitted from the transmitter, whereby when medication is dispensed from at least one of the medication cassettes, the light detected from the transmitter is interrupted and an audible and visual alarm which is included in the circuit of the transmitter and detector is activated.

9. The device of claim 8 wherein the housing further includes a time indicating slot where an indicator representing a subdivision of a week is visible.

10. The device of claim 9 wherein the housing further includes a removable cap with raised sides, the diameter of the raised sides of the cap being slightly greater than that of the medication cassettes, thus each medication cassette is adapted to fit with in the cap to aid in the placement of medication within the medication cassette.

* * * * *